US006492101B1

(12) United States Patent
Kim et al.

(10) Patent No.: US 6,492,101 B1
(45) Date of Patent: Dec. 10, 2002

(54) SILVER HALIDE EMULSIONS PRECIPITATED IN THE PRESENCE OF ORTHO-SUBSTITUTED WATER-SOLUBLE DISULFIDES

(75) Inventors: Sang H. Kim, Pittsford, NY (US); George J. Burgmaier, Pittsford, NY (US); Bradley K. Jensen, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/825,324

(22) Filed: Apr. 3, 2001

(51) Int. Cl.[7] ..... G03C 1/34; G03C 1/07
(52) U.S. Cl. ..... 430/567; 430/569; 430/611
(58) Field of Search ..... 430/567, 569, 430/611

(56) References Cited

U.S. PATENT DOCUMENTS

| | | | | |
|---|---|---|---|---|
| 3,397,986 A | | 8/1968 | Millikan et al. | |
| 5,217,859 A | | 6/1993 | Boettcher et al. | |
| 5,219,721 A | | 6/1993 | Klaus et al. | |
| 5,364,754 A | * | 11/1994 | Kim et al. | 430/569 |
| 5,418,127 A | * | 5/1995 | Budz et al. | 430/611 |
| 5,476,761 A | * | 12/1995 | Verbeeck et al. | 430/569 |

* cited by examiner

*Primary Examiner*—Janet Baxter
*Assistant Examiner*—Amanda C. Walke
(74) *Attorney, Agent, or Firm*—Andrew J. Anderson

(57) ABSTRACT

A method of making a monodisperse regular grain silver halide high bromide emulsion is described comprising precipitating regular silver halide grains comprising greater than 50 mole percent bromide, based on total silver, in a reaction vessel, and adding to the reaction vessel before or during precipitation a disulfide compound represented by the following formula (I):

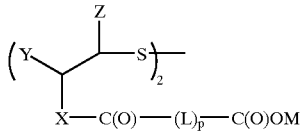

where Y and Z are H atoms or substituents, which may be connected to form a carbocyclic or heterocyclic ring, X is —O—, —NH— or —NR—, where R is a substituent; M is —H— or a cationic species; and L is a linking group, where p is 0 or 1. The invention further provides a silver halide emulsion prepared by the method, and a photographic element comprising a silver halide emulsion prepared by the method. The use of water soluble disulfide compounds of the above formula in the preparation of regular grain high bromide emulsions provides the antifoggant advantages of water soluble disulfide compounds in a monodisperse emulsion, while avoiding the problem of large grain contamination in such emulsions.

20 Claims, No Drawings

SILVER HALIDE EMULSIONS PRECIPITATED IN THE PRESENCE OF ORTHO-SUBSTITUTED WATER-SOLUBLE DISULFIDES

FIELD OF THE INVENTION

The present invention relates to the use of water-soluble disulfide compounds in the preparation of monodisperse regular (non-tabular) grain light-sensitive silver halide emulsions.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog can be defined as a developed density that is not associated with the action of the image-forming exposure, and is usually expressed as "D-min", the density obtained in the unexposed portions of the emulsion. Density, as normally measured, includes both that produced by fog and that produced as a function of exposure to light. It is known in the art that the appearance of photographic fog related to intentional or unintentional reduction of silver ion (reduction sensitization) can occur during many stages of preparation of the photographic element including silver halide emulsion preparation, spectral/chemical sensitization of the silver halide emulsion, melting and holding of the liquid silver halide emulsion melts, subsequent coating of silver halide emulsions, and prolonged natural and artificial aging of coated silver halide emulsions.

The control of fog, whether occurring during the formation of the light-sensitive silver halide emulsion, during the spectral/chemical sensitization of those emulsions, during the preparation of silver halide compositions prior to coating on an appropriate support, or during the aging of such coated silver halide compositions, has been attempted by a variety of means. Mercury-containing compounds, such as those described in U.S. Pat. Nos. 2,728,663; 2,728,664; and 2,728,665, have been used as additives to control fog. Thiosulfonates and thiosulfonate esters, such as those described in U.S. Pat. Nos. 2,440,206; 2,934,198; 3,047,393; and 4,960,689, have also been employed. Organic dichalcogenides, for examples the disulfide compounds described in U.S. Pat. Nos. 1,962,133; 2,465,149; 2,756,145; 2,935,404; 3,184,313; 3,318,701; 3,409,437; 3,447,925; 4,243,748; 4,463,082; and 4,788,132 have been used not only to prevent formation of fog but also as desensitizers and as agents in processing baths and as additives in diffusion transfer systems. More recently, U.S. Pat. No. 5,364,754 describes the use of primarily water-insoluble organic dichalcogenides during the preparation of silver halide crystals to modify the grain growth of silver hlaide crystals in addition to preventing formation of fog without a concomitant large loss in sensitivity. U.S. Pat. No. 5,418,127 describes the use of certain water soluble disulfide compounds which provide the combined attributes of high water solubility and strong antifogging activity with de minimus impact on sensitivity.

A problem has been discovered when attempting to employ some of the water soluble disulfide compounds described in U.S. Pat. No. 5,418,127 in the preparation of monodisperse conventional regular grain silver halide high bromide emulsions. Regular grains are three-dimensional (non-tabular) grains which are substantially internally free of crystal plane stacking faults. Specifically, it has been discovered that the presence of some of such compounds during the precipitation of such emulsion grains lead to the formation of a significant fraction of large grain contamination, generally due to formation of some larger tabular grains. It would be desirable to provide a process for the preparation of monodisperse regular grain emulsions which would enable the use of water soluble disulfide compounds in order to take advantage of the combined attributes of high water solubility and strong antifogging activity with only minimal impact on sensitivity, while avoiding the disadvantages of large grain contamination when emulsion grain size monodispersity is desired.

SUMMARY OF THE INVENTION

This invention provides a method of making a monodisperse regular grain silver halide high bromide emulsion comprising precipitating regular silver halide grains comprising greater than 50 mole percent bromide, based on total silver, in a reaction vessel, and adding to the reaction vessel before or during precipitation a disulfide compound represented by the following formula (I):

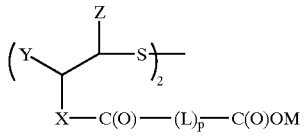

where Y and Z are H atoms or substituents, which may be connected to form a carbocyclic or heterocyclic ring; X is —O—, —NH— or —NR—, where R is a substituent; M is —H— or a cationic species; and L is a linking group, where p is 0 or 1. In preferred embodiments, Y and Z are connected to form a further substituted or unsubstituted phenyl ring.

This invention further provides a silver halide emulsion prepared by the method, and a photographic element comprising a silver halide emulsion prepared by the method. The use of water soluble disulfide compounds of the above formula in the preparation of monodisperse high bromide emulsion grains in accordance with the invention provides the antifoggant advantages of the general class of compounds described in U.S. Pat. No. 5,418,127 in a monodisperse emulsion, while avoiding the problem of large grain contamination in such emulsions.

DETAILED DESCRIPTION OF THE INVENTION

The disulfide compounds employed in accordance with the invention are represented by following formula (I):

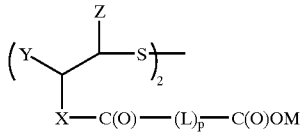

Y and Z are H atoms or substituents, which may be connected to form a carbocyclic or heterocyclic ring. In preferred embodiments, Y and Z are connected to form a further substituted or unsubstituted phenyl ring. X is independently an —O—, —NH— or —NR—. Most preferably X is —NH—. L is a linking group, and p is 0 or 1. In particularly preferred embodiments, the disulfide compound employed is of the formula (II):

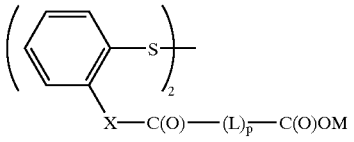

Substituents represented by Y, Z and R, as well as further substituents which may be present Y and Z connect to form a further substituted phenyl ring, are selected from those which do not interfere with the intended function of the disulfide compound in the photographic emulsion and which maintains the water solubility of the compound. Examples of suitable substituents include alkyl groups (for example, methyl, ethyl, hexyl), fluoroalkyl groups (for example, trifluoromethyl), aryl groups (for example, phenyl, naphthyl, tolyl), sulfonyl groups (for example, methylsulfonyl, phenylsulfonyl). Preferred are simple alkyl groups and simple fluoroalkyl groups.

Preferably L is a unsubstituted alkylene group and is usually —$(CH_2)_n$— where n ranges from zero to 11 and is preferably 1 to 3. Other examples of L are given below:

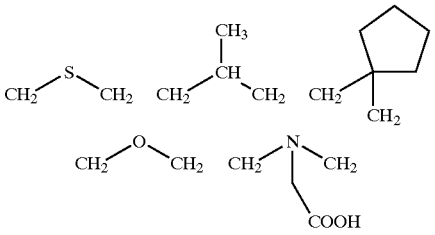

M is either a hydrogen atom or a cationic species if the carboxyl group is in its ionized form. The cationic species may be a metal ion or an organic ion. Examples of organic cations include ammonium ions (for example, ammonium, tetramethylammonium, tetrabutylammonium), phosphonium ions (for example, tetraphenylphosphonium), and guanidyl groups. Preferably M is hydrogen or an alkali metal cation, with a sodium or potassium ion being most preferred.

Examples of disulfide compounds of formula (I) which may be employed in accordance with this invention include compounds I-A through I-G shown below.

I-A

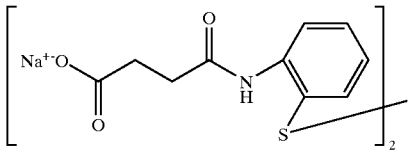

I-B

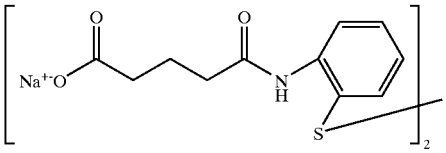

-continued

I-C

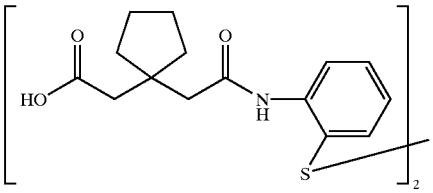

I-D

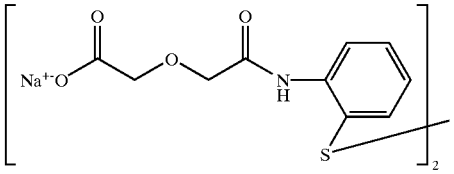

I-E

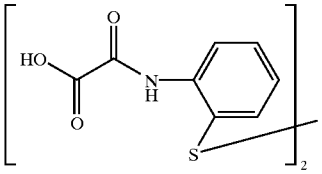

I-F

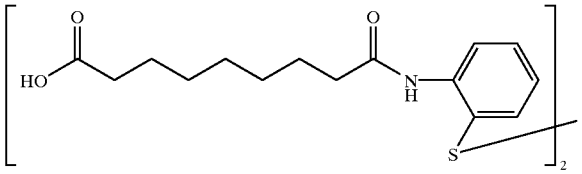

I-G

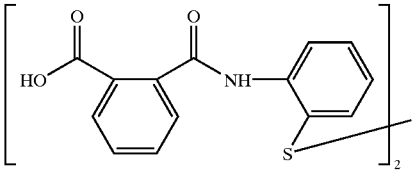

I-H

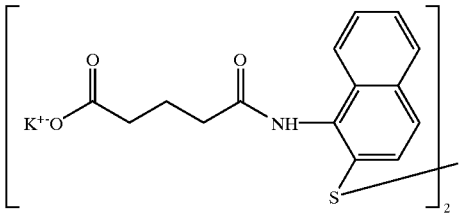

I-I

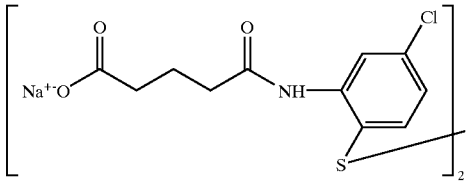

I-J

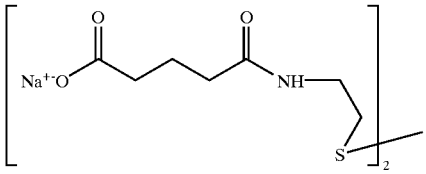

-continued

I-K

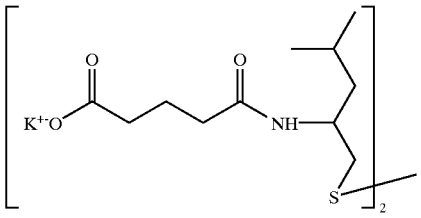

The solubilized disulfides employed in the invention are easily prepared using readily available starting materials. Most of the solubilized disulfides can be obtained by reacting aminophenyl disulfide or hydroxyphenyl disulfide with the appropriate cyclic anhydride followed by conversion of the free diacid to its anionic form using materials such as sodium bicarbonate. Other solubilized disulfides could be obtained by reacting aminophenyl disulfide or hydroxyphenyl disulfide with the mono chloride of a dicarboxylic acid mono ester, followed by hydrolysis of the ester to the carboxylic acid. Representative synthetic examples are provided in U.S. Pat. No. 5,418,127 referenced above, the disclosure of which is incorporated herein in its entirety. Solubilized non-phenyl disulfides can similarly be obtained by employing analogous non-phenyl reactants.

The method of the invention is specifically directed towards the preparation of monodisperse regular grain high bromide silver halide emulsions. The term monodisperse is intended to refer to emulsions having a coefficient of variation (COV) of grain size of less than 25% (preferably less than 20%), where COV is defined as 100 times the standard deviation ($\sigma$) of grain size divided by the average grain size. Regular grains are conventional three-dimensional (non-tabular) grains which are substantially internally free of crystal plane stacking faults. The term "high bromide" is intended to refer to emulsion grains comprising at least 50 (preferably 70 and optimally 90) mole percent bromide, based on silver, with any remaining halide being bromide, chloride, or mixtures thereof. Preferably, at least 0.5 (more preferably 1.0) mole percent iodide may be present in the emulsion grains to provide increased photographic speed. While iodide may be present up to saturation levels, it is preferably limited to less than 20 (optimally less than 10) mole percent, based on silver, with any remaining halide being chloride. Silver bromide, chlorobromide, iodochlorobromide, chloroiodobromide and iodobromide emulsions are contemplated.

In accordance with the invention, emulsion grain monodispersity is improved specifically during the precipitation of high bromide regular grains by the reduction of larger than average size grain fractions. The shape of regular silver halide grains in general tends to vary with composition. Silver chloride grains, for example, are usually cubic (i.e., bounded by 6 {100} crystal faces), while high bromide silver halide grains may be cubic, octahedral (bounded by 8 {111} crystal faces) or cubo-octahedral (bounded by 6 {100} and 8 {111}faces). Monodisperse emulsions of this invention may be generally prepared by precipitating silver halide crystals in a colloidal matrix by methods conventional in the art. The colloid is typically a hydrophilic film forming agent such as gelatin, alginic acid, or derivatives thereof. Monodisperse emulsions are typically prepared by a double-jet precipitation process, wherein silver and halide salt solutions are concurrently run into a reaction vessel. Double-jet precipitation as normally practiced is a batch precipitation process, but may also be performed in a continuous precipitation process wherein a portion of the emulsion formed is being continuously removed. *Research Disclosure,* Item 38957, Section I. "Emulsion grains and their preparation" describes conventional precipitation procedures.

In a typical emulsion precipitation process, at least about 10% of the dispersing medium (water and peptizer) forming the final emulsion is initially placed in a reaction vessel. Up to 100% of the final emulsion volume can be present initially in the reaction vessel, since water and soluble salts can be continuously removed by ultrafiltration, as illustrated by Mignot U.S. Pat. No. 4,334,012. At least 10% of the final peptizer can be initially present in the reaction vessel, but no peptizer is required until grain nucleation occurs. The concentration of peptizer in the dispersing medium during grain nucleation and growth is usually less than 5 wt %, typically 1 to 3 wt %. A minor amount of halide ion (e.g., less than 10% of total halide precipitated) is typically initially introduced into the dispersing medium to insure a stoichiometric excess of halide ion during precipitation. The pH of the dispersing medium is usually in the range of from 2.0 to 9.0, typically 3.0 to 7.0. The strong mineral acids HCl and $HNO_3$ and the bases NaOH and KOH are typically used to adjust pH. Temperatures in the reaction vessel usually range from 20 to 90° C., preferably 30 to 80° C. A soluble silver salt (e.g., silver nitrate) is introduced through one jet. Concurrently a soluble halide salt (e.g., an ammonium halide, an alkali halide or an alkaline earth halide) is introduced through a second jet. When the pH of the dispersing medium is acid, an ammonium counter ion behaves no differently than an alkali metal counter ion. When the pH of the dispersing medium is alkaline, however, ammonium ion acts as a ripening agent.

In the formation of high bromide grains, the boundary between cubic and octahedral/cubo-octahedral depends, in large part, on the silver ion concentration of the precipitating conditions, generally reported as pAg (−log [Ag+]). Typically, octahedral grains form at a higher pAg than cubic grains. The presence of iodide increases the probability of forming grains with octahedral faces, and shifts the boundary to a lower pAg. At a fixed pAg, the grain shapes are progressively more octahedral as the amount of iodide in the emulsions is increased. See generally "The Theory of the Photograph Process," T. H. James, ed., 4th Ed., Mac-millan Publishing Co., Inc. (1977) p. 94. The present invention is particularly applicable to the preparation of monodisperse octahedral or cubooctahedral silver halide high bromide emulsions.

The crystals formed in the precipitation step may be chemically and spectrally sensitized, as known in the art. Chemical sensitization of the emulsion employs sensitizers such as sulfur-containing compounds, e.g., allyl isothiocyanate, sodium thiosulfate and allyl thiourea; reducing agents, e.g., polyamines and stannous salts, noble metal compounds, e.g., gold, platinum; and polymeric agents, e.g., polyalkylene oxides. A temperature rise is employed to complete chemical sensitization (heat treatment). Spectral sensitization is effected with agents such as sensitizing dyes. For color emulsions, dyes are added in the spectral sensitization step using any of a multitude of agents described in the art. It is known to add such dyes both before and after heat treatment.

After spectral sensitization, the emulsion is coated on a support. Various coating techniques include dip coating, air knife coating, curtain coating and extrusion coating.

In accordance with the invention, the disulfide compounds are added to the silver halide emulsion reaction vessel either before the start of or during precipitation. They can be added to the reaction vessel containing the aqueous gelatin salt solution before the start of the precipitation; they can also be added during precipitation to the salt solution, the silver nitrate solution, or from a separate jet directly into the kettle. However, there is some indication that greater activity may be achieved if the disulfides are added in the salt solution or directly to the vessel before the start of precipitation. The compounds can be added from the beginning or part-way-through precipitation. Parameters such as temperature, stirring time and other variables for precipitating conventional emulsions are known to those skilled in the art.

When the disulfide compounds are added from an aqueous solution it is advantageous to use the alkaline earth salt of the disulfide. Alternatively, the free acid can be used by co-dissolution with appropriate molar equivalents of base, or the free acid can be prepared as a solid particle dispersion and added to the silver halide emulsion, gelatin-only overcoat, or interlayer. Preferably the disulfide compounds are added as the aqueous solution of the alkaline earth salt. Additionally, the disulfide compounds of this invention can be used in combination with sulfinate salts as described in U.S. patent application Ser. No. 978,539, Klaus and Leonard, filed Nov. 19, 1993.

The optimal amount of the disulfide compound to be added will depend on the desired final result, the type of emulsion, the degree of ripening, the point of addition, the chemical structure, and other variables. In general the concentration of disulfide compound which may be utilized is from about $1\times10^{-9}$ to about $1\times10^{-2}$ mol/mol Ag, with $1\times10^{-7}$ to $1\times10^{-2}$ mol/mol Ag being preferred and about $1\times10^{-5}$ to $8\times10^{-4}$ mol/mol Ag being most preferred.

Combinations of the disulfide compounds may be used. The disulfide compounds may also be used in combination with other antifoggants and finish modifiers.

The disulfide compounds are particularly useful with intentionally or unintentionally reduction sensitized emulsions. As described in *The Theory of the Photographic Process,* 4th edition, T. H. James, Macmillan Publishing Company, Inc., 1977, pages 151–152, reduction sensitization has been known to improve the photographic sensitivity of silver halide emulsions. Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion).

During precipitation of a silver halide emulsion, unintentional reduction sensitization can occur when silver nitrate or alkali solutions are added rapidly or with poor mixing to form emulsion grains, for example. Also silver halide emulsions precipitated in the presence of ripeners (grain growth modifiers) such as thioethers, selenoethers, thioureas, or ammonia tend to facilitate reduction sensitization.

Examples of reduction sensitizers and environments which may be used during precipitation or spectrochemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979).

Examples of processes for preparing intentionally reduction sensitized silver halide emulsions are described in EP 0 348934 A1 (Yamashita), EP 0 369491 (Yamashita), EP 0 371388 (Ohashi,), EP 0 396424 A1 (Takada), EP 0 404142 A1 (Yamada) and EP 0 435355 A1 (Makino).

The disulfide compounds are also particularly useful with emulsions doped with Group VIII metals such as iridium, rhodium, osmium and iron as described in *Research Disclosure*, December 1989, Item 308119, published by Kenneth Mason Publications, Ltd., Dudley Annex, 12a North Street, Emswirth, Hampshire P010 7DQ, ENGLAND. It is common practice in the art to dope emulsions with these metals for reciprocity control.

A general summary of the use of iridium in the sensitization of silver halide emulsions is contained in Carroll, "Iridium Sensitization: A Literature Review," Photographic Science and Engineering, Vol. 24, No. 6, 1980.

A method of manufacturing a silver halide emulsion by chemically sensitizing the emulsion in the presence of an iridium salt and a photographic spectral sensitizing dye is described in U.S. Pat. No. 4,693,965. The low intensity reciprocity failure characteristics of a silver halide emulsion may be improved, without significant reduction of high intensity speed, by incorporating iridium ion into the silver halide grains after or toward the end of the precipitation of the grains is described in U.S. Pat. No. 4,997,751. The use of osmium in precipitating an emulsion is described in U.S. Pat. No. 4,933,272 (McDugle).

In some cases, when such dopants are incorporated, emulsions show increased fresh fog and a lower contrast sensitometric curve when processed in the color reversal E-6 process as described in The British Journal of Photography Annual, 1982, pages 201–203.

The photographic elements of this invention can be nonchromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. This invention may be particularly useful with those photographic elements containing a magnetic backing such as described in No. 34390, *Research Disclosure, November,* 1992.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of this invention can include various dye-forming couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain, among other things, brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable, and then developed with a color developer. Additionally, the preceding process can be employed but before uniformly fogging the emulsion the remaining silver halide is dissolved and the developed silver is converted back to silver halide; the conventional E-6 process is then continued and results in a negative color image. Alternatively, a direct positive emulsion can be employed to obtain a positive image.

Development is followed by the conventional steps of bleaching, fixing, or bleach-fixing, to remove silver and silver halide, washing and drying.

The following examples are intended to illustrate, without limiting, this invention.

EXAMPLES

In addition to the use of water soluble disulfide compounds I-A and I-B in invention examples, the following corresponding para substituted phenyl disulfide compounds C-A and C-B are employed in comparison examples:

C-A

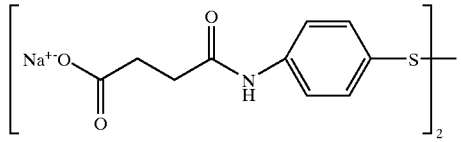

C-B

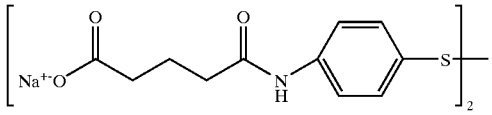

Compound I-A=Bis(sodium o-succinamidophenyl)disulfide ("oSDPD")

Compound C-A=Bis(sodium p-succinamidophenyl) disulfide ("pSDPD")

Compound I-B=Bis(sodium o-glutaramidopbenyl)disulfide ("oGDPD")

Compound C-B=Bis(sodium p-glutaramidophenyl)disulfide ("pGDPD")

Example 1

Monodisperse regular grain silver bromoiodide emulsions (4.8 mole % I, 0.17–0.18 micrometer average grain size, containing octahedral and cubooctahedral grains) were precipitated in the presence of water soluble disulfide compounds I-A, C-A, I-B, or C-B by the following double jet procedure at 52° C. to produced 1 mole samples of total silver precipitation for each of corresponding Emulsions A, B, C and D:

A reactor vessel was charged with 25.9 g de-ionized bone gelatin, 79 mg dithiaoctanediol, 253 micromoles of disulfide (specified in Table I below) and 959 cc distilled water. The disulfides were dissolved in distilled water at 3.12 mg/cc concentration. 2.5M $AgNO_3$ was added to the reactor at a constant flow rate of 16 cc/min. After the first nucleation of 0.0364 moles of silver for 0.9 min, 2.5M NaBr was continuously added as double jet while controlling vAg at 15 mV. After the second nucleation of 0.0388 moles for 1 min, 1 M KI solution was added at 4.8 cc/min for 10 min. At 3.9 min into the precipitation, 14.8 cc of 507 g/l ammonium sulfate solution was added to the reactor. After 1 min 36.2 cc of 2.5 M NaOH was added. After growing grains for 17.6 min 1 mg $K_2IrCl_6$ was added. Total run time for silver addition was 24 min. At the end of precipitation, pH was brought down to 6 and temperature was adjusted to 40° C. for ultra-filtration. The final emulsion, comprising mainly octahedral and cubooctahedral grains, was analyzed for grain size and distribution. Grain size data and photographic data are summarized in the following table. The grain size and distribution was determined by a disc centrifuge technique. The size is area weighted median, and COV (coefficient of variation) is a measure of size distribution (standard deviation/mean×100). The % large grain fraction was determined by number weighted distribution from the disc centrifuge measurement. For the case of Emulsion A, five batches were made and the data listed are averages of the five batches.

TABLE I

| Emulsions | Disulfides | Size (μm) | COV % | % Large Grains |
|---|---|---|---|---|
| Emulsion A (Invention) | I-A (oSDPD) | 0.177 | 16 | 0 |
| Emulsion B (Comparison) | C-A (pSDPD) | 0.172 | 21 | 9.6 |
| Emulsion C (Invention) | I-B (oGDPD) | 0.180 | 18 | 0 |
| Emulsion D (Comparison) | C-B (pGDPD) | 0.174 | 19 | 12.5 |

The inventive emulsions precipitated in the presence of water soluble disulfides of formula (I) in accordance with the invention provided a smaller COV (i.e., more mondispersed) without any significant large grain fractions (i.e., a single grain size distribution peak was obtained). The comparison emulsions precipitated in the presence of the para substituted phenyl disulfide counter parts contained a significant percentage of large grains (evidenced by a second distribution peak at about 0.47 μm grain size).

Example 2

Emulsion E was made like Emulsion D (employing comparison compound C-B) except that ditbiaoctanediol was omitted. Its grain size was 0.116 μm with 25% COV and it contained 14.4% large grain fraction. Emulsion F was made like Emulsion E, but employing compound I-A in place of compound C-B. Its grain size was 0.12 μm with 22% COV and it did not contain any detectable large grain fraction.

Example 3

Two emulsions(G and H) were made similarly to Emulsion A employing water soluble disulfide compound I-A in accordance with the invention, but instead of being adding to the reaction vessel separately prior to grain precipitation, the disulfide compound was added dissolved in the $AgNO_3$ solutions at 220 and 330 μmoles/silver mole, respectively. Both emulsions did not show any detectable large grains.

Comparison Example 4

Tabular grain silver iodobromide (3 mol % iodide) emulsion I was precipitated in a growth reactor by a conventional double jet procedure to produce a 1 mole sample of total silver precipitation at 60° C. The reactor vessel was charged with 0.56 g deionized bone gelatin, 0.88 g NaBr, 91 mg dithiaoctanediol, and 843 cc distilled water. PH of the kettle was adjusted to 3.6. A silver nitrate solution (2.5M $AgNO_3$) and a salt solution (2.425M NaBr+0.075M KI) were pumped in 4.1 cc/min to the reactor for 1 min nucleation. After holding for 23 min, 181 g distilled water containing 17.3 g deionized bone gelatin was added to the reactor and pH was adjusted to 4.6 during 5 min hold period. The nucleated silver halide grains were grown by accelerated flows of the silver nitrate solution for 68.5 min while maintaining reactor vAg at 36 mV by addition of the salt solution. After precipitating 91.5% of the total silver, 0.44 mg $K_2IrCl_6$ was added.

Tabular grain silver iodobromide emulsion J was similarly precipitated, but with disulfide compound I-A (188 mg/Ag mole) added to the growth reactor. The resultant emulsions were analyzed for grain size and distribution by a disc centrifuge technique, with the results as indicated in Table II. In each instance, the average tabular emulsion grain thickness was also measured to be 0.128 μm.

TABLE II

| Emulsions | Dilsulfide | Size (μm) | % COV | Aspect ratio |
|---|---|---|---|---|
| Emulsion I | None (check) | 0.91 | 27 | 7.1 |
| Emulsion J | I-A | 0.82 | 53 | 6.4 |

In this example, addition of soluble disulfide I-A to the reactor during the preparation of a tabular grain emulsion did not result in a monodispersed emulsion, and in fact rather resulted in an increase in COV.

While the invention has been described in detail and with reference to specific embodiments thereof, it will be apparent to one skilled in the art that various changes and modifications can be made therein without departing from the spirit and scope thereof.

What is claimed is:

1. A method of making a monodisperse regular grain silver halide high bromide emulsion comprising precipitating regular silver halide grains comprising greater than 50 mole percent bromide, based on total silver, in a reaction vessel, and adding to the reaction vessel before or during precipitation a disulfide compound represented by the following formula (I):

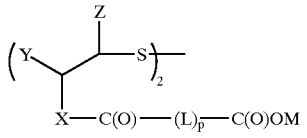

where

Y and Z are H atoms or substituents, which may be connected to form a carbocyclic or heterocyclic ring;

X is —O—, —NH— or —NR—, where R is a substituent;

M is —H— or a cationic species; and

L is a linking group, where p is 0 or 1.

2. The method of claim 1 wherein Y and Z are connected to form a further substituted or unsubstituted phenyl ring.

3. The method of claim 1 wherein the disulfide compound is represented by the following formula (II):

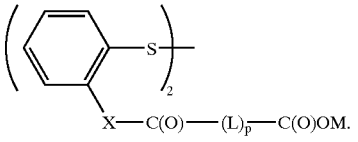

4. The method of claim 3 wherein the regular silver halide grains comprise octahedral or cubooctahedral grains.

5. The method of claim 4 wherein p is 1, and L is $—(CH_2)_n—$, where n is 1 to 11.

6. The method of claim 5 wherein n is 1 to 3; and M is —H— or an alkali metal cation.

7. The method of claim 6 wherein X is —NH—.

8. The method of claim 4 wherein the silver halide emulsion is greater than 90 mole % silver bromide.

9. The method of claim 4 wherein the silver halide emulsion is greater than 95 mole % silver bromide.

10. The method of claim 4 wherein the disulfide compound is added to the reaction vessel as an aqueous solution.

11. The method of claim 1 wherein the regular silver halide grains comprise octahedral or cubooctahedral grains.

12. The method of claim 1 wherein p is 1, and L is —$(CH_2)_n$—, where n is 1 to 11.

13. The method of claim 12 wherein n is 1 to 3; and M is —H— or an alkali metal cation.

14. The method of claim 13 wherein X is —NH—.

15. The method of claim 1 wherein the silver halide emulsion is greater than 90 mole % silver bromide.

16. The method of claim 1 wherein the silver halide emulsion is greater than 95 mole % silver bromide.

17. The method of claim 1 wherein the disulfide compound is added to the reaction vessel as an aqueous solution.

18. A silver halide photographic element comprising a silver halide emulsion prepared by the method of claim 1.

19. A silver halide photographic element comprising a silver halide emulsion prepared by the method of claim 4.

20. A silver halide photographic element comprising a silver halide emulsion prepared by the method of claim 11.

* * * * *